United States Patent [19]

Heier

[11] 4,168,784

[45] Sep. 25, 1979

[54] FLAT PACKAGE VENDING MACHINE

[75] Inventor: William Heier, Warminster, Pa.

[73] Assignee: U-Seal-It Vending Co., Inc., Philadelphia, Pa.

[21] Appl. No.: 839,333

[22] Filed: Oct. 5, 1977

[51] Int. Cl.[2] ..... B65H 3/24

[52] U.S. Cl. ..... 221/125; 221/274

[58] Field of Search ..... 221/125, 131, 276, 250, 221/251, 274

[56] References Cited

U.S. PATENT DOCUMENTS

| | | | |
|---|---|---|---|
| 2,105,644 | 1/1938 | Gebert et al. | 221/125 X |
| 2,305,342 | 12/1942 | Fry | 221/125 |
| 2,904,214 | 9/1959 | Miller | 221/250 X |
| 3,073,481 | 1/1963 | Steiner | 221/125 X |
| 3,360,091 | 12/1967 | Baum | 221/125 X |

*Primary Examiner*—Stanley H. Tollberg

*Attorney, Agent, or Firm*—Weiser, Stapler & Spivak

[57] ABSTRACT

An adjustable, multi-product vending machine is disclosed which is capable of dispensing a large number of products in a relatively small space using a limited number of coin slides. The device is activated by one or more coin slides which may be of the multi-coin type and comprises a plurality of variable width product dispensing bins, each of which is equipped with a vend plate assembly for individual operation. The bins are easily adjustable in width to accommodate products of various sizes and one vend plate assembly is provided for each bin. An interlock system interacts with the plurality of vend plate assemblies to prevent dispensing more than one product during each operation of a coin slide.

15 Claims, 9 Drawing Figures

FLAT PACKAGE VENDING MACHINE

BACKGROUND OF THE INVENTION

The invention relates generally to the field of vending machines, and more particularly, is directed to a compact, multi-product type of dispensing apparatus.

Coin operated vending machines are in general use throughout the country in great variety and in enormous numbers. The prior art devices encompass mechanical operators, electrical operators and numerous combinations of both. The devices presently in use vary from the simplest type of mechanical designs to highly sophisticated electrically and electronically functioned machines. Generally, when it is desired to vend and dispense a single product, relatively inexpensive and simply designed mechanisms have been designed and have proved highly satisfactory for the purpose. When multi-product type of vending is desired, the vending machines have tended to become quite complicated in construction and extremely expensive both in development expenditures and in production costs. Additionally, the multi-product vending machines tend to become relatively large and cumbersome in order to house the highly complex and detailed operating components.

In addition to the drawbacks of initial design costs, the expenses of manufacture and the generally large sizes inherent in presently available multi-product types of dispensing apparatus, the very complexity of these machines renders them prone to mechanical or electrical breakdown, thereby increasing the probability of expensive repairs and maintenance. Of course, when a dispensing machine is inoperative because of mechanical failure, there will be an attendant loss of operating revenue until such time as a service man can be modified and scheduled to perform the required repair or maintenance procedures necessary to again render the machine operative.

SUMMARY OF THE INVENTION

The present invention relates to a multi-product type of vending machine in general, and more particularly, is directed to a completely mechanical, easily adjustable, multi-product dispenser capable of vending a plurality of products in a relatively small space.

Within an enclosing cabinet are positioned at least a pair of vertically spaced vend tables or tiers, each of which can be sub-divided into a plurality of product containing compartments or bins. In the preferred embodiment, each tier is provided with compartment adjustment means, which may be bayonet slots, to accommodate products variable in width from two inches to twelve inches. Thus, each tier can be readily adjusted to vend six two-inch wide products, four three-inch wide products, three four-inch wide products, two six-inch wide products, one twelve inch product or any desired combinations thereof.

Each compartment is equipped with a vend plate assembly which is responsive to coin operation of a conventional single coin or multi-coin type of coin slide. A transverse interlock is built in each tier to prevent function of more than one vend plate assembly upon each cyclical operation of a coin slide. The interlock comprises a channel or track within which are transversely movable a plurality of discs. Each vend plate assembly includes a spreader plate which is in planar alignment with the discs and which is fabricated of a thickness or height sufficient to spread the discs upon operation. By providing a free area or opening within the channel not occupied by discs, the space thus provided can be occupied by only one spreader plate at one time. Accordingly, when one vend plate assembly is functioned and its spreader plate is pulled into alignment with the channel, the spreader plate will move the discs to align the open space and the interlock will automatically function to prevent operation of any other vend assembly.

By inserting another coin or coins and operating the coin slide, the previously employed spreader plate will be pushed from alignment with the interlock, thereby clearing the machine for operation of any one of the other vend assemblies. If desired, two coin slides may be utilized, one to activate each tier. Either or both coin slides can be of one coin or multi-coin type to thus permit multi pricing of products within a single, inexpensive, mechanical dispensing machine.

Each of the vend plate assemblies comprises an operating handle which is movably connected to a vend plate by a fixed, threaded stud or other connector which rides in an elongated slot in the vend plate. A spreader plate is upwardly affixed to the vend plate and terminates rearwardly in a downwardly turned flange. As above set forth, the spreader plate is movable by the handle into alignment with the machine interlock system. The coin slide removably engages the vend plate assembly at the downwardly turned flange to initially push the vend plate to a rearward position upon function of the coin slide. Movement of the vend plate rearwardly also clears the spreader plate from association with the interlock system. Once the interlock is cleared, any of the vend plate assembly handles can be pulled to dispense only that product stored in the bin associated with the selected vend plate assembly.

Accordingly, in an extremely modest space, a plurality of vend assemblies can be positioned for selective vending of any of a plurality of products. All of the vend assemblies are simple in configuration, mechanical in operation and easily interchangeable for product line adjustment purposes.

It is therefore an object of the present invention to provide an improved mechanical vending machine of the type set forth which is capable of functioning with limited coin chutes.

It is another object of the present invention to provide a novel vending machine adapted to store and dispense a plurality of products in a limited space.

It is another object of the invention to provide a novel product vending machine equipped with means to easily adjust for dispensing products of differing widths.

It is another object of the present invention to provide a novel vending machine comprising an interlock system capable of preventing the dispensing of more than one product following each operation of a coin slide.

It is another object of the present invention to provide a novel mechanical, multi-product dispensing machine including a plurality of vend plate assemblies, each vend plate assembly comprising a handle, a vend plate responsive to operation of the handle, a spreader plate connected to the vend plate for interlock system operation and means to clear the interlock system upon function of a coin slide.

It is another object of the present invention to provide a novel mechanical vending machine that is simple in design, inexpensive in manufacture and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENTS OF THE INVENTION

Figure 1:
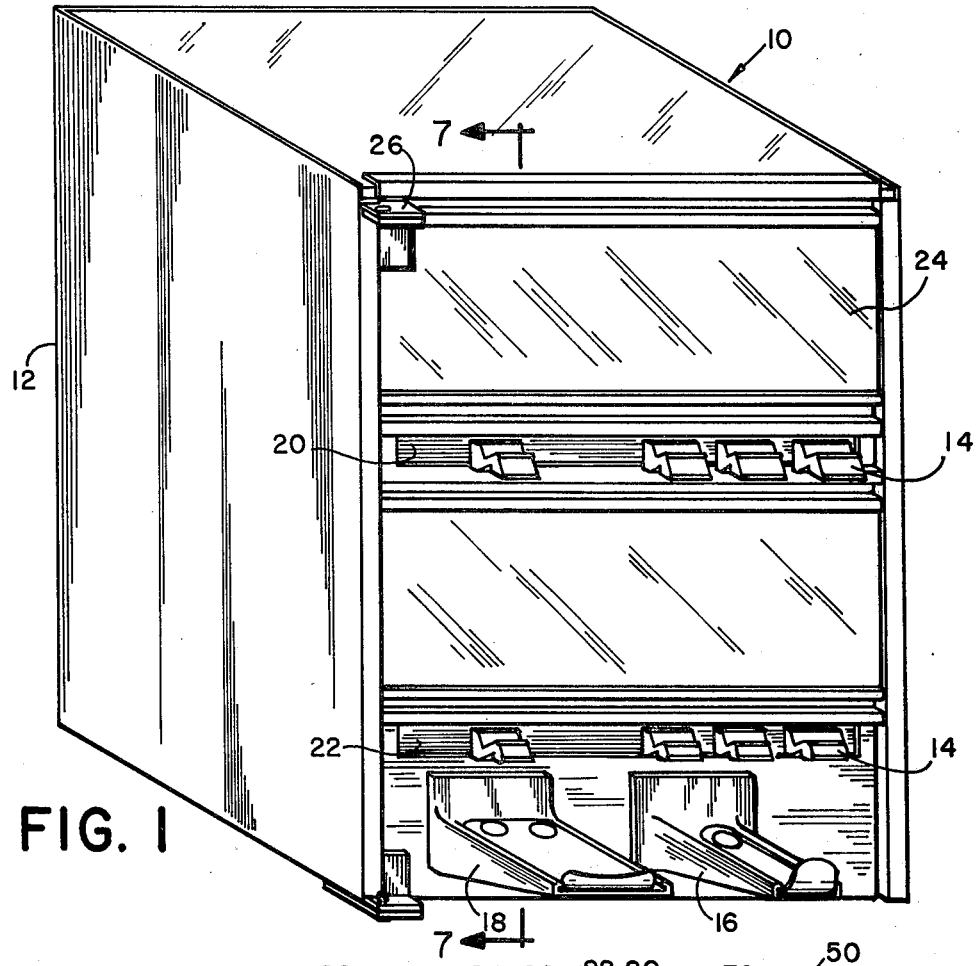
FIG. 1 is a front perspective view of the vending machine of the present invention showing two coin chutes.

Referring now to the drawings, there is shown in FIG. 1 a vending machine 10 comprising generally an enclosing cabinet 12 from which a plurality of vend assembly handles 14 project for manual operation in the manner hereinafter more fully set forth. A single coin slide 16 and a multiple coin slide 18 also are mounted in the cabinet 12 to selectively initiate machine operation in well known manner by accepting the predetermined number and denomination of coins. As illustrated, the product vend assemblies, as represented by the plurality of handles 14 are arranged in a plurality of tiers, for example, an upper tier 20 and a lower tier 22. In accordance with usual practice, a portion of the cabinet, for example, the front 24 is removably secured to permit easy access to the machine interior for product loading, coin removal, maintenance or servicing operations. A locking system 26 of known design can also be provided.

Figure 2:
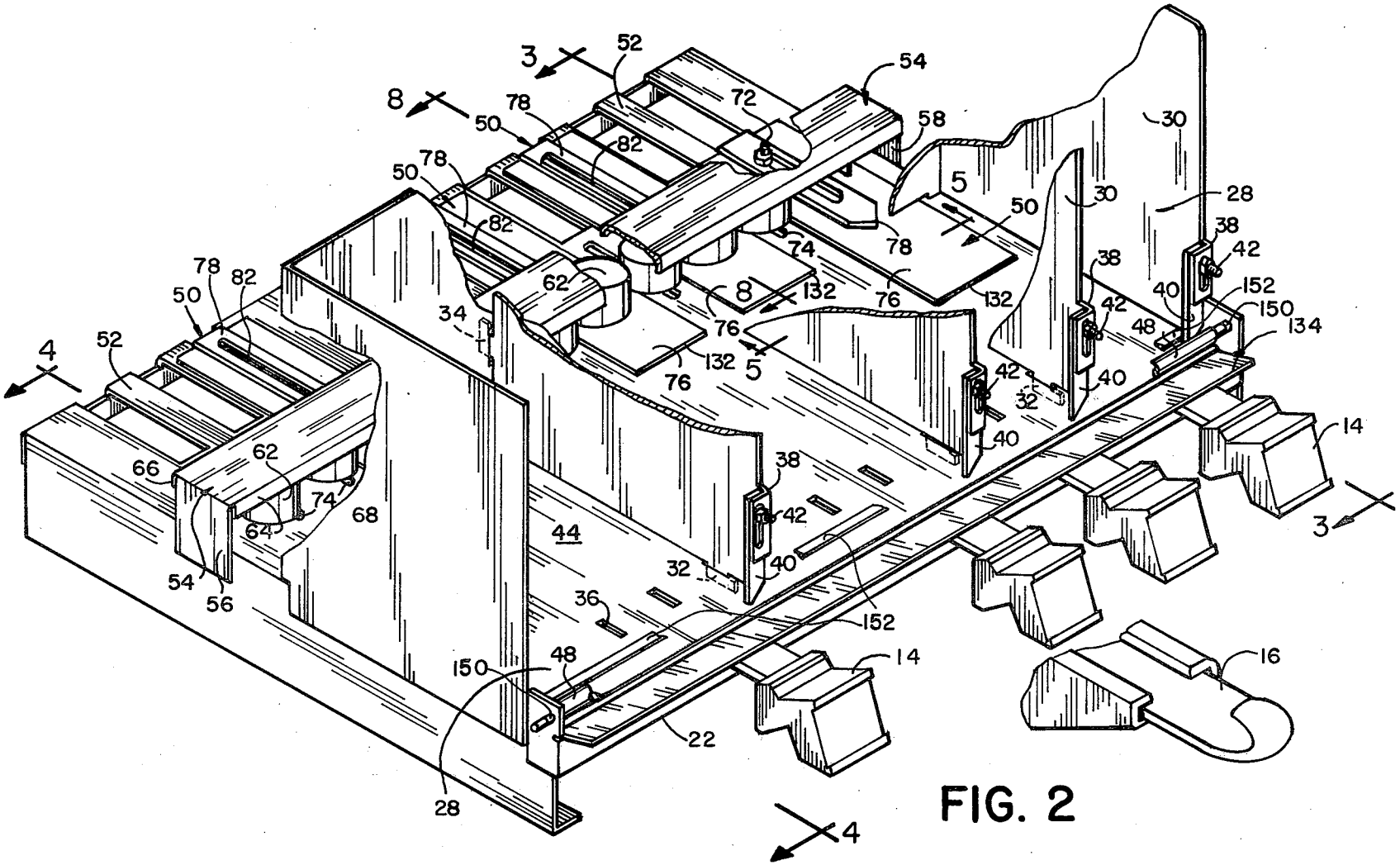
FIG. 2 is an enlarged, partial, perspective view of one tier with the cover removed, and partially broken away to expose interior construction details.

As best seen in FIG. 2, each tier 20 or 22 is provided with facilities to define a plurality of compartments or bins 28 which may be of the same width or which may be formed of different widths. Partitions 30 are equipped with bottom tabs 32 and rear tabs 34 which removably engage slots 36 provided in the machine chassis 44. In this manner, each bin 28 can be readily varied in width, simply by changing the location of the partitions by engaging different slots 36 in the chassis. In the preferred embodiment, the slots 36 are arranged to define compartments of minimum two inches in width and with a maximum of six similar compartments which can be placed side by side. By providing such a modular arrangement, the same tier can optionally be employed to accommodate one twelve inch wide compartment, or two six inch compartments, or three four inch compartments or four three inch wide compartments or combinations thereof. One vend plate assembly including a handle 14 is positioned to render each compartment thus defined functionally operative. Slots 74 are provided in the chassis at one inch intervals to thereby permit installation of a vend assembly 50 whenever desired.

One or more of the partitions 30 defining a side wall of each compartment or bin 28 is provided with a vertical channel 38 within which a picker 40 is vertically adjustable. An adjustable locking means 42 which may include an elongated slot and a threaded fastener to secure the picker 40 in a desired vertical position spaced above the top of the chassis 44 is provided to easily adjust the picker to conform to the height of the product being vended. Thus, if the product (not shown) was 0.018 inches in height, the lower terminus of the finger of the picker 40 should be elevated above the top of the chassis 44 a distance slightly greater to thereby permit the product to pass therebetween when vended. The picker lower terminus should be elevated above the chassis insufficiently to permit two products to pass simultaneously therebetween. An anti-theft bar 48 is pivotal in front of the pickers to discourage tampering as more fully set forth.

Still referring to FIG. 2, it will be observed that one vend plate assembly 50 is mounted to vend the products contained in each of the bins 28. A plurality of mounting bars 52 are spaced at the rear of the chassis in modular arrangement to receive and mount a vend plate assembly whereby one vend plate assembly can be provided for each bin or compartment 28 regardless of the number or width of compartments chosen for operation.

A channel member 54 transversely spans the chassis 44 and is spaced thereabove by left and right brackets 56, 58 to define an interlock space 60 within which a plurality of interlock discs 62 are transversely movable. The channel member 54 includes forward and rearward flanges 64, 66 which depend from the web 68 to retain the discs 62 within the interlock space 60 as the discs move transversely as hereinafter more fully described. It will be noted that the total cumulative widths of the discs 62 plus the width of one spreader plate of a vend assembly 50 will equal the transverse length of the channel member 54. In this manner, the discs 62 function as an interlock system and positively prevent entrance of more than one spreader plate beneath the channel member 54 at one time. Thus, when one vend assembly 50 is functioned to dispense a single product (not illustrated), the interlock system will function to prevent operation of any other vend assembly.

Figure 8:
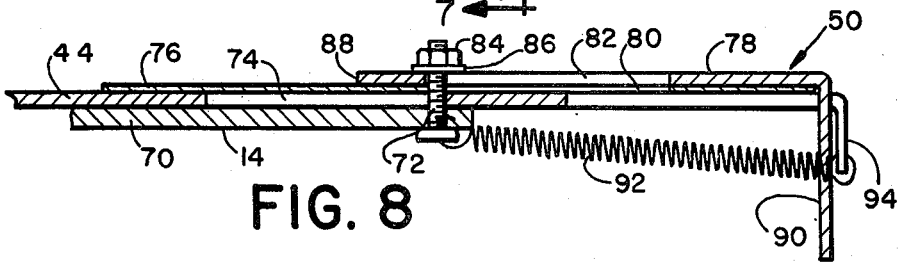
FIG. 8 is an enlarged, partial, cross sectional view of a vend plate assembly, taken along line 8—8 of FIG. 2, looking in the direction of the arrows.
Figure 9:
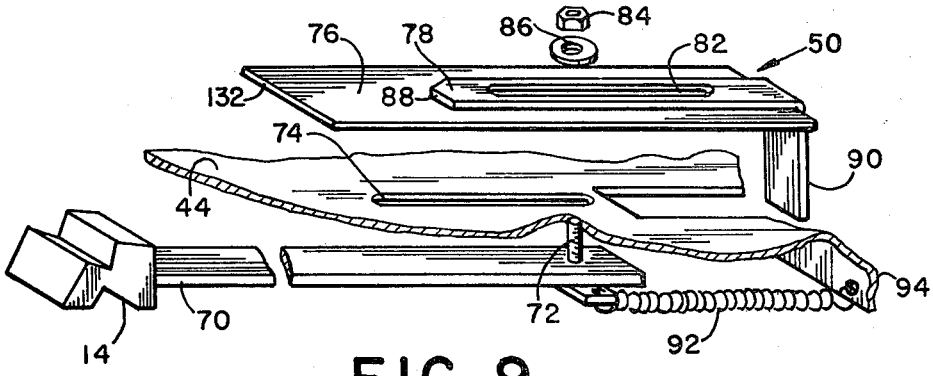
FIG. 9 is an exploded, perspective view of the vend plate assembly of FIG. 8.

As illustrated in FIGS. 8 and 9, each vend plate assembly 50 comprises an operating handle 14 which is directly connected to an operating strap 70. The strap 70 reciprocally functions below the chassis 44 and rearwardly carries an upstanding threaded stud 72 which is secured therein. Each stud 72 projects upwardly through a longitudinally elongated opening 74 which is provided in the chassis. Of course, since the device is modular in construction, and it is intended to accommodate a plurality of vend plate assemblies 50, a plurality of similar elongated openings 74 are formed through the chassis in transverse alignment to facilitate mounting of a vend assembly in any desired transverse position, whereby a vend plate assembly can be provided for each bin or compartment 28 as defined by the partitions 30.

Still referring to FIGS. 8 and 9, the vend plate assembly further comprises a vend plate 76 which rests upon and is longitudinally reciprocal over the top surface of the chassis 44. Preferably, the vend plate may be between 0.018 and 0.25 inches in thickness. A spreader plate 78 is spot welded or otherwise secured to the top of the vend plate 76 and is reciprocal therewidth. Each of the vend plate and spreader plates are provided respectively with a longitudinally elongated opening 80, 82 which openings vertically register and receive therethrough the stud 72. A nut 84 and washer 86 secure the parts together both below and above the chassis 44.

The spreader plate 78 terminates forwardly in a generally V-shaped point 88 which is utilized to contact the discs 62 in the interlock system and to spread them apart on either side of the spreader plate 78 as the spreader plate is forwardly pulled over the chassis 44 upon activation of a handle 14. The spreader plate 78 terminates rearwardly in a depending flange 90 for setting the machine in an initial position as hereinafter more fully set forth. A return spring 92 interconnects between the stud 72 and the rear wall 94 of the machine 10 to continuously bias the operating strap 70 and the affixed handle 14 to an initial rearward position, ready for use.

Figure 3:
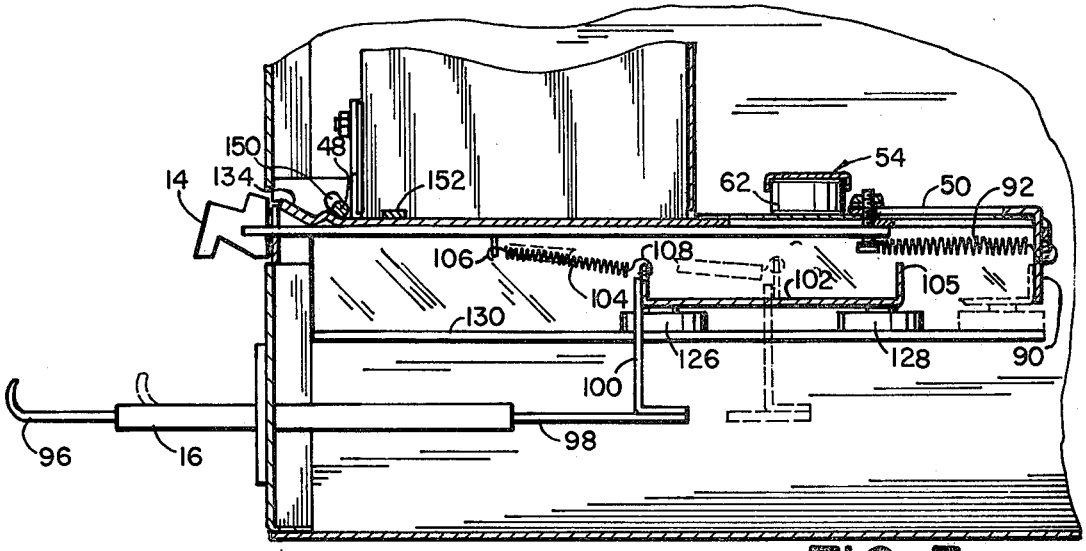
FIG. 3 is an enlarged, partial, cross sectional view, taken along line 3—3 of FIG. 2, looking in the direction of the arrows.

Referring now to FIG. 3, the function and operation of a first coin slide, for example the single coin slide 16 will now be described. Upon inserting the proper coin (not shown), the slide handle 96 can be rearwardly urged to the position indicated in broken lines. The rearward extension 98 of the handle 96 carries an upright arm 100 which extends sufficiently to contact and engage a movable channel 102 to push the channel rearwardly as the slide handle 96 is urged rearwardly. The channel 102 terminates rearwardly in an up-standing flange 105 which is positioned to engage and rearwardly push against the downwardly depending flange 90 of the vend plate assembly 50. A spring 104 interconnects between a connector 106 affixed to the chassis and a connector 108 which is movable with the channel 102 to continuously bias both the channel 102 and the slide handle 96 to the forward position, as illustrated in full lines.

Figure 7:
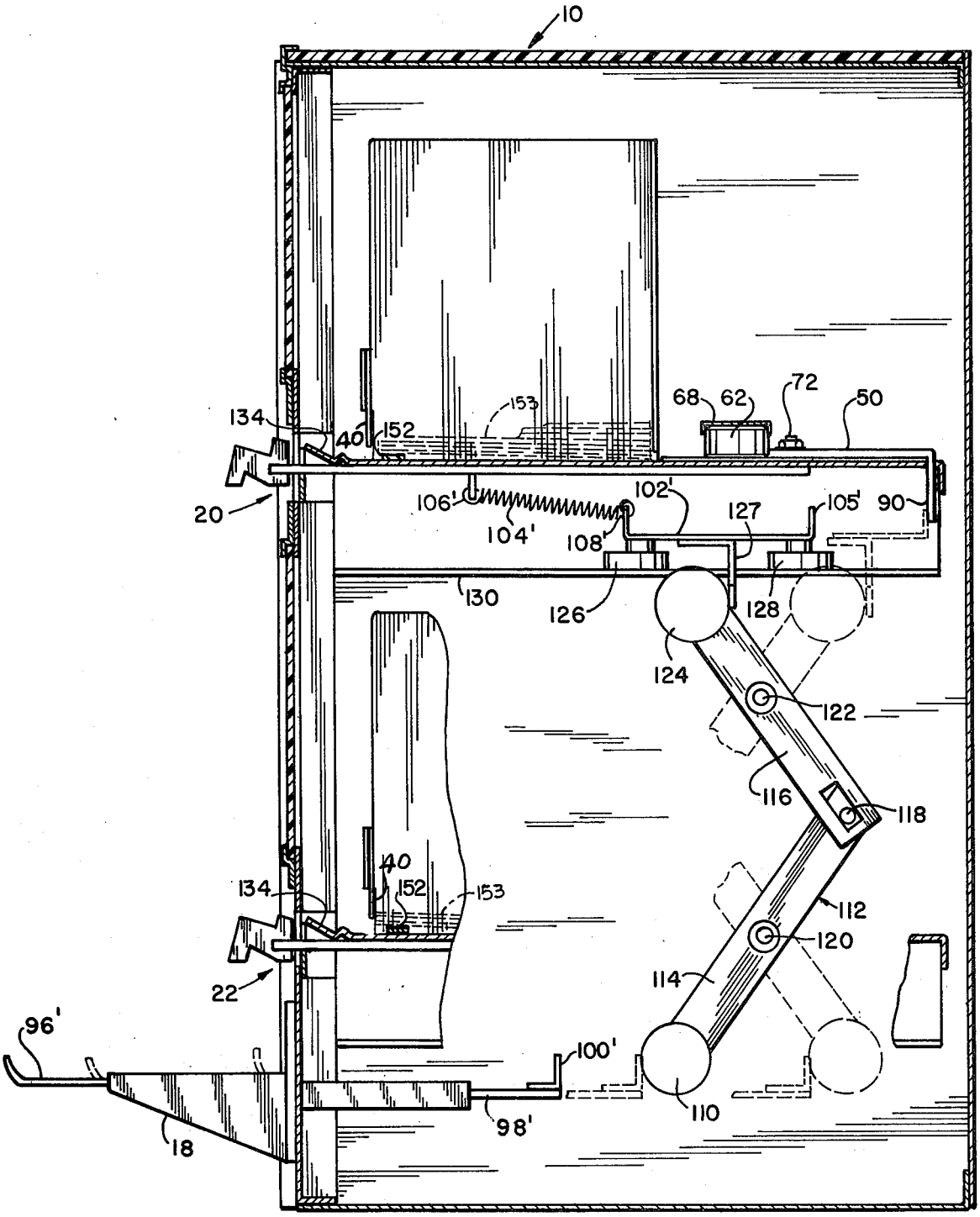
FIG. 7 is a partial, enlarged, cross sectional view, taken along line 7—7 of FIG. 1 showing the upper tier arming apparatus.

The vend plate assemblies 50 comprising the upper tier 20 may be similarly armed as illustrated in FIG. 7 when a coin or coins of sufficient number and denomination are inserted into the second or multiple coin slide 18. The slide handle 96' is rearwardly urged to the position indicated in broken lines to urge the rearward handle extension 98' rearwardly. The rearward extension 98' carries an upright arm 100' which is positioned to engage and rearwardly urge the bottom terminus 110 of a bell crank mechanism 112. As illustrated, the bell crank mechanism comprises a lower arm 114 which pivotally interconnects to an upper arm 116 about a sliding pivot 118 in usual manner. The lower arm 114 is pivotal about a medial, fixed pivot 120 and the upper arm is pivotal about a medial, fixed upper pivot 122. The upper arm 116 terminates upwardly in an upper terminus 124 which is positioned to engage and rearwardly urge the depending flange 127 of an upper channel member 102'. The channel 102' terminates rearwardly in an upstanding flange 105' which is positioned to engage and rearwardly push against the upper vend plate assembly 50. If desired, the channels 102, 102' may be slidable over a table 130 on slides or discs 126, 128 to facilitate operation of the mechanism. A spring 104' interconnects between a connector 106' affixed to the chassis and a second connector 108' which is movable with the channel 102' to continuously bias both the channel 102' and the slide handle 96' (through the bell crank mechanism 112) to the forward position, as illustrated in full lines.

Figure 4:
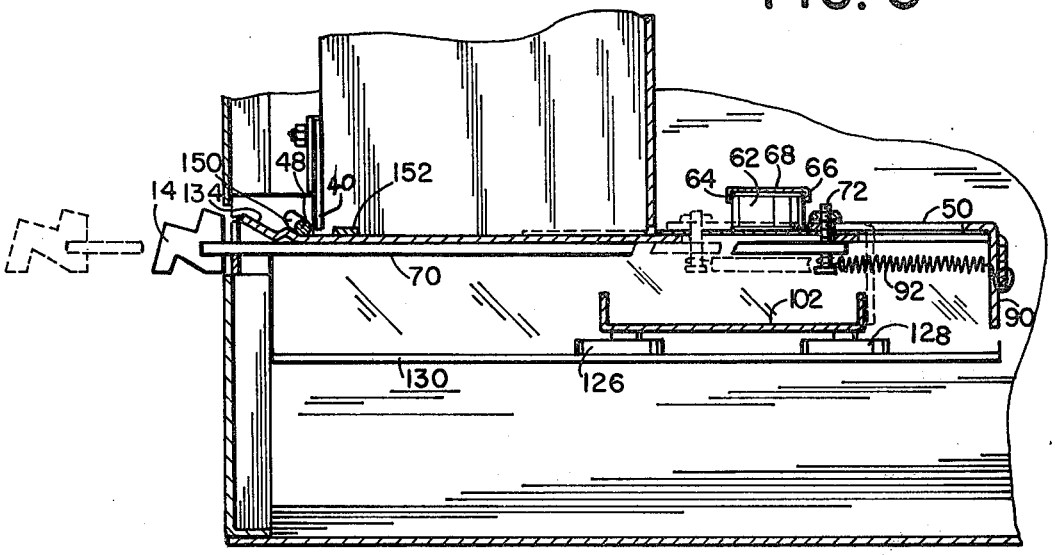
FIG. 4 is a view similar to FIG. 3 showing operation of the vend plate assembly, taken along line 4—4 of FIG. 2.

Referring particularly to FIGS. 3 and 4, the operation of the vending machine 10 will now be described. After inserting the correct coin or coins into the coin slide 16 (or 18) the slide handle 96 is pushed to the position indicated in broken lines to urge the channel 102 rearwardly to the position indicated in broken lines. This operation functions to push the vend plate 76 and spreader plate 78 of the previously used vend plate assembly 50 rearwardly to thereby remove the spreader plate 78 from association with the discs 62 comprising the interlock assembly. The spring 104 functions to automatically return the slide handle 96 to the initial, full line position. With all of the spreader plates thus urged to their most rearward positions, a selected one of the vend handles 14 can be grasped and pulled forwardly. It is noteworthy that the spreader plate and vend plate ride rearwardly as the registered aligned slots 82, 80 pass the stud 72, when slide handle 96 is rearwardly urged.

As illustrated in FIG. 4, when the vend handle is pulled forwardly to the position illustrated in dotted lines, the vend strap 70 and upright stud 72 will also be pulled forwardly to pull the vend plate 76 and the spreader plate 78 forwardly. The leading edge 132 (FIG. 9) of the vend plate 76 will engage and force forwardly the lowermost one of a stack of vendable products (not illustrated) that have been positioned within the compartment 28. In this operation, it is noteworthy that the stud 72 rides forwardly within one of the elongated openings 74 which has been provided in the chassis for this purpose. The lowermost product (not shown) will then be vended between the space defined between the picker finger 46 and the chassis 44 and through the anti-theft device 48. If desired, a short vend table 134 can be provided to facilitate product delivery.

Figure 5:
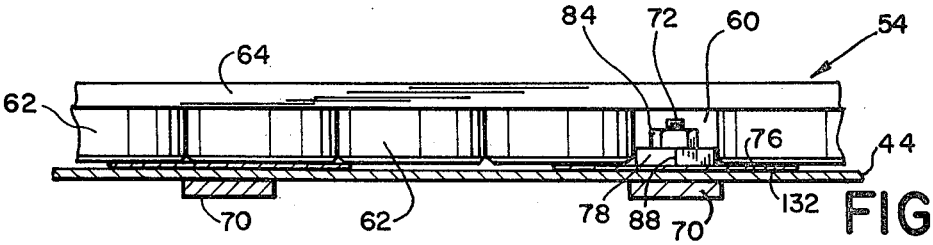
FIG. 5 is an enlarged, partial, cross sectional view taken along line 5—5 of FIG. 2, looking in the direction of the arrows.
Figure 6:
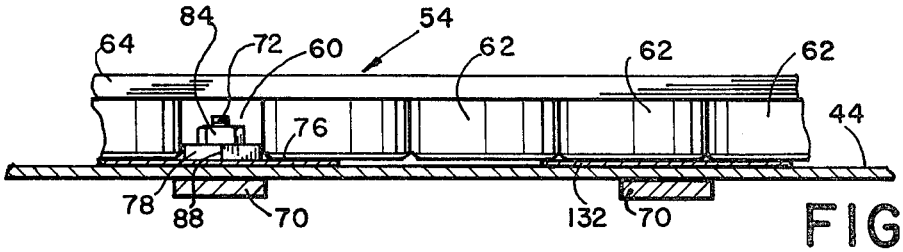
FIG. 6 is a view similar to FIG. 5 showing the position of parts in the interlock system upon function of another of the vend plate assemblies.

It will be noted that the forward urging of one spreader bar 78 causes its pointed front 88 to engage one or more discs 62 to move the discs transversely along the channel member 54 as the spreader plate is moved into alignment with the row of discs 62. As best seen in FIG. 6, once one spreader plate has been pulled into the interlock system, the discs 62 act to prevent a second spreader plate from entering the interlock area. As hereinbefore set forth, inasmuch as the vend plate 76 and the spreader 78 are permanently interconnected, prevention of forward movement of a second spreader plate will also prevent forward movement of a second vent plate, thereby preventing the vending of two products simultaneously. By inserting a second coin, the coin slide can be activated to again clear all spreader plates 78 from association with the interlock discs 62, thereby allowing a product from another bin 28 to be vended as illustrated in FIGS. 5 and 6.

In order to prevent theft from the device, as illustrated in FIGS. 2, 3 and 4, an anti-theft bar 48 is transversely positioned across the front of the machine immediately behind the vend table 134. The bar 48 is movably retained within the spaced, elongated slots 150 in a manner to ride forwardly when the product (not shown) is being dispensed and to wedge rearwardly in the event an object was inserted into the vend opening from the outside in an effort to steal from the machine. As shown, the spaced slots 150 incline downwardly from front to rear to normally urge the bar or anti-theft rod 48 to its lowermost, wedging position. The product, when vended acts to lift the bar 48 by urging the bar forwardly and upwardly within the slots 150 as the product is pulled forwardly upon operation of a handle 14. When the bar is lifted sufficiently to provide a clearance space, the product can then be dispensed over the vend table 134.

In an additional anti-theft feature, a transverse step or barrier 152 (FIGS. 2 and 7) can be spot welded or otherwise affixed to the chassis 44 to prevent a knife or other flat object from being inserted into the machine from the front in an attempt to push the channel 102 or the individual vend assemblies rearwardly. The flat vendable packages 153 rest upon the step 152 and are forwardly vended through the space defined between the step 152 and the picker 40 upon operation of a vend assembly 50.

By spacing the elongated openings 74 at one inch intervals in the chassis 44, optimum universal employment of the device can be achieved within a minimum amount of space and with a limited number of coin slides required. As hereinbefore set forth, the bins 28 are modular in design and can be adjusted to the desired number and width to vend products of different widths. By providing the number of spaced, elongated chassis slots 74, a vend assembly 50 can be located in any desired position for each bin 28 so constructed. The interlock system 54 with the discs 62 functions to permit only one vend assembly 50 to be activated upon each operation of a coin slide 16 or 18.

Although the invention has been described with a certain degree of particularlity, it is understood that the present disclosure has been made only by way of example and that numerous changes in the details of construction and the combination and arrangement of parts may be resorted to without departing from the scope of the invention.

What is claimed is:

1. A vending machine for flat packages of the type including a coin slide comprising an interlock assembly positioned within the machine, said interlock assembly comprising a plurality of movable members, said members being adapted to be spread to define an opening;

a first vend plate assembly movable relative to the interlock assembly from an initial position to a vend position, said vend plate assembly comprising a handle movable between an initial position and a vend position, said vend plate assembly further comprising a spreader means movable between an initial position and a vend position in response to movement of the handle to spread the members and define an opening, the spreader means moving into the opening when in the vend position, said vend plate assembly further comprising a vend plate, the vend plate being secured to the spreader means, said vend plate contacting and vending a package when the handle is moved to the vend position, the handle being adapted to move the vend plate from an initial position to a vend position when the handle is moved from its initial position to the vend position, means to return automatically the handle to the initial position after the handle has been moved to the vend position, the vend plate being adapted to remain in the vend position after the handle has been returned to the initial position, the vend plate comprising an elongated opening and the handle comprising a vend plate actuator, the said actuator being adapted to pull the vend plate to the vend position when the handle is moved to the vend position.

2. The vending machine of claim 1 wherein the means to return is a spring.

3. The vending machine of claim 1 wherein the actuator rides in the said elongated opening to allow the handle to move relative to the vend plate when the handle is returned to the initial position and the vend plate remains in the vend position.

4. The vending machine of claim 1 wherein the vending machine comprises a flat chassis and wherein a first part of the vend assembly is positioned above the chassis and a second part of the vend assembly is positioned below the chassis.

5. The vending machine of claim 4 wherein the first part of the vend assembly comprises the vend plate.

6. The vending machine of claim 4 wherein the first part of the vend assembly comprises the vend plate and the spreader means.

7. The vending machine of claim 4 wherein the second part of the vend assembly comprises the handle.

8. The vending machine of claim 4 and adjustable picker means to be mounted forwardly of the vend plate above the chassis to define a space above the chassis through which the package is urged by the vend plate.

9. The vending machine of claim 1 and a second vend plate assembly mounted in vertical, spaced relationship above the first vend plate assembly.

10. The vending machine of claim 9 and means to operate the second vend plate assembly, said means to operate comprising a bell crank.

11. The vending machine of claim 10 wherein the means to operate comprise a second coin slide.

12. The vending machine of claim 1 and anti-theft means to prevent access to the packages without first functioning the coin slide.

13. The vending machine of claim 12 wherein the anti-theft means comprises a transverse bar, said bar being contacted by a package as the package is vended.

14. The vending machine of claim 13 wherein the bar is adapted to move in an inclined plane relative to the plane of the vend assembly.

15. The vending machine of claim 14 wherein the inclined plane inclines downwardly from the front to the rear of the machine.

* * * * *